United States Patent [19]

Pope

[11] Patent Number: 4,969,300

[45] Date of Patent: Nov. 13, 1990

[54] ROTATABLE BUILDING

[76] Inventor: Ralph E. Pope, 2525 Ivy St. East, Cumming, Ga. 30130

[21] Appl. No.: 478,516

[22] Filed: Feb. 12, 1990

[51] Int. Cl.[5] ..... E04B 1/346

[52] U.S. Cl. ..... 52/65

[58] Field of Search ..... 52/64, 65; 104/35, 45; 272/28 R, 28 S

[56] References Cited

U.S. PATENT DOCUMENTS

| | | | |
|---|---|---|---|
| 3,338,176 | 8/1967 | Petersen | 104/35 |
| 4,694,620 | 9/1987 | Pope | 52/65 |
| 4,753,173 | 6/1988 | James | 104/45 |

*Primary Examiner*—John E. Murtagh

*Attorney, Agent, or Firm*—Scrivener and Clarke

[57] ABSTRACT

The lower edge of a wall of a cylindrical rotatable building has a radially inwardly extending flange of inverted U-shape which encompasses the upper peripheries of wheels rotatably mounted on horizontal axles carried on a fixed foundation for the building. The inverted U-shape of the flange not only supports the building for free rotation about a vertical axis but it at all times spaces the building wall from direct engagement with the wheels while restraining the building against substantially any lateral movement relative to the fixed foundation for the building.

10 Claims, 1 Drawing Sheet

ROTATABLE BUILDING

This invention relates to buildings and more particularly to a rotatable multi-purpose building particularly adapted to the storage of a variety of disparate articles.

In my earlier U.S. Pat. No. 4,694,620 I disclose a cylindrical multi-purpose, rotatable building having a horizontal flange adjacent its lower edge engaging horizontal rollers. In addition, vertical rollers are also provided to prevent the horizontal flange from binding on the foundation wall whenever the building shifts sideways. The two sets of rollers are expensive and, furthermore, it is undesirable to permit the building wall to have any significant sideways movement since this can cause articles stacked in the building close to the wall to be knocked over and also scattered should the building shift sideways during rotation thereof.

The object of the present invention is to provide an improved roller mounting for a rotatable building which is considerably less expensive than the arrangement of my prior patent yet is effective to restrain the building against any significant lateral shifting while still providing ease of rotation equal to or better than the prior arrangement.

The invention will be better understood when read in conjunction with the accompanying drawings wherein.

Figure 1:
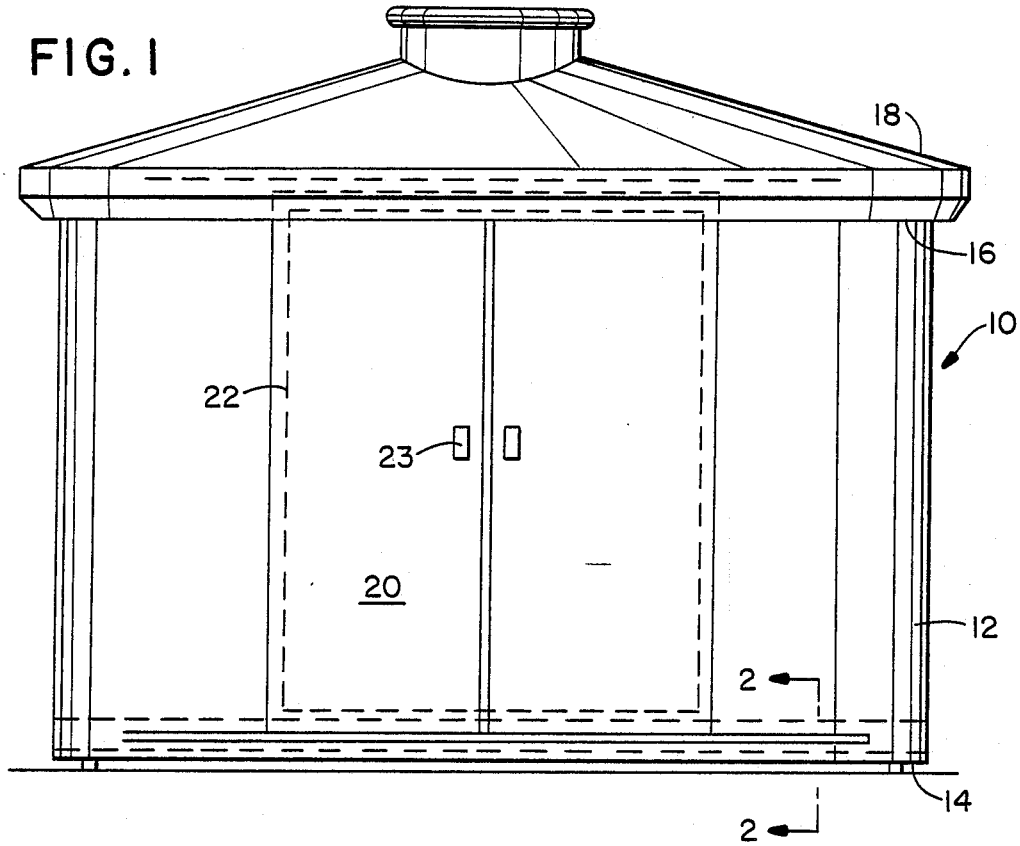
FIG. 1 is a front elevational view of a circular rotatable building incorporating the present invention.

Referring now to the drawings, 10 designates a circular rotatable building comprising an upstanding vertical wall 12 having a lower edge 14 and an upper edge 16 joined to a conical roof 18. The wall 10 has an access opening 20 with doors 22 suitably mounted for closing the opening 22. As described in my prior U.S. Pat. No. 4,694,620, the pertinent parts of which are incorporated herein by referral thereto, the building wall 12 is mounted on roller means, and means, such as the side edges of the opening, corrugation in wall 12, or the door handles 23, are provided to enable the building to be rotated until the opening aligns with any selected region of the interior of the building to permit access to articles stored in that region.

Improved means are provided by the invention for supporting the building for rotation while also preventing it from being moved laterally or from tipping. To this end, the lower end of the building wall defines an annular skirt portion 24 having inner and outer faces 28, 30 and whose lower edge defines lower edge 14 of the building. A fixed foundation, generally designated by the numeral 32 and later described in more detail, extends upwardly from a support surface 34 and has an outwardly facing vertical wall 36 which is telescopically and co-axially received in radially spaced relationship within the skirt portion 24. A plurality of circumferentially spaced wheels 38 having inner and outer sides 39, 40 are carried on radially extending horizontal axles 41 mounted on the vertical wall 36 of the foundation 32 in positions spacing the lower peripheries of the wheels vertically clear of the support surface 34. The axles also radial space the inner and outer sides 39, 40 of the wheels 38 from the vertical wall 36.

First flange means, generally designated by the numeral 42, extends radially inwardly from the inner face

28 of the skirt portion 24. The flange means 42 has a central portion 44 resting on the upper peripheries of the wheels 38 in a position spacing the lower edge 14 of the skirt portion 24 vertically clear of the support surface 34. The first flange means 42 has an outer leg portion 46 sloping downwardly and radially outwardly from the central portion 44 into the space between the outer sides 40 of the wheels 38 and the inner face 28 of the skirt portion 24 and is rigidly connected to the inner face of the skirt portion by means herein after described. The flange 42 has an inner leg 48 extending downwardly and radially inwardly from the central portion 44 of the flange 42 into the space between the inner sides 39 of the wheels 38 and the vertical wall 36 of the foundation 32. The central portion 44 and outer and inner leg portions 46, 48 closely encompass the wheels 38 at a position spaced inwardly from the inner face of the skirt portion 29 to position the flange means 42 intermediate the wall 36 and inner face 28 of the skirt portion 24 and to restrict horizontal movement of the skirt portion and hence the building 10 relative to the foundation 32.

Figure 2:
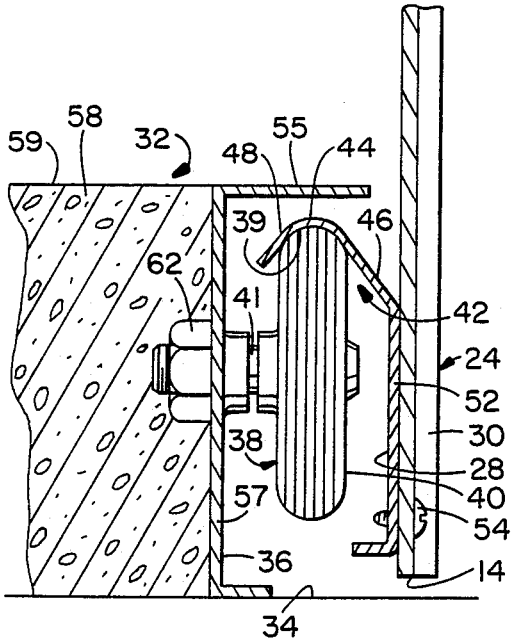
FIG. 2 is an enlarged vertical cross sectional view taken substantially on the line 2—2 of FIG. 1.

As can be seen in FIG. 2, the outer peripheral portion of each wheel 38 has a predetermined cross sectional shape, say arcuate as shown, and the central portion 44 of the first flange means 42 has a shape which is complementary to the cross sectional shape of the wheels. Further, it will be noted that the outer and inner leg portions 46, 48 are so formed that they, in conjunction with the central portion 44 of the first flange means 42, at all times retain the inner face 28 of the skirt portion 24 spaced radially clear of the wheels and axles 38, 41. To further ensure against lateral movement of the building relative to the fixed foundation the first flange means 42 is of substantially inverted U-shape with means, such as the vertical flange 52 integral with the outer leg portion 46 and machine screws 54, releasably fastening the outer leg portion 46, and hence the entire first flange means, rigidly to the inner face of the skirt means 24.

Figure 3:
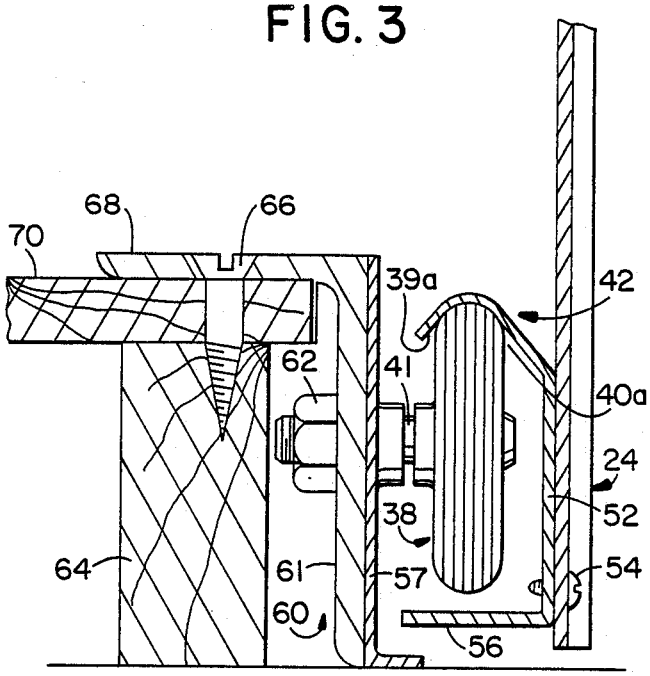
FIG. 3 is a view similar to FIG. 2 but showing a modification.

Because the skirt portion 24 of the building is annular and the first flange means 42 defines an annular inverted substantially U-shaped track which itself is movable in a circular path on wheels rotatable about fixed axes, in accordance with the invention, the spacing, indicated by the numerals **39*a* and 40*a* in FIG. 3, between the outer radial portions of the inner and outer sides 39, 40 of the wheels and the inner faces of the leg portions 46, 48 of the flange means 42 is selected so that as the track travels its circular path, the sides of the wheels in that region do not frictionally rub against the inner faces of the leg portions 46, 48 of the flange means with sufficient resistance to impede easy manual rotation of the building. Thus for a building whose skirt has a relatively short radius, the cross sectional profiles of the interengaging portions of the wheels and flange are selected so that only a relatively small part of the inner faces of the leg portions 46, 48** of the flange are in rubbing engagement with the radially outer side portions of the wheels. As the radius of the skirt portion increases, more of the wheel sides and the inner faces of the leg portion can engage since any binding problems decrease the closer the path of travel of the track on the wheels approaches a straight line. In any event, whatever slight binding may exist initially will decrease as the wheels and track wear into each other from prolonged use.

Even though the degree of interengagement between the wheels and central portion of the flange is in proportion to the radius of the skirt portion the leg portions 46, 48 of the first flange means 42 nevertheless extend a substantial distance, as shown, into the spaces between the wheel sides 39, 40 and the foundation outer wall 36 and the inner face 28 of the skirt portion, respectively, to prevent any undue lateral movement of the building relative to the foundation in response to an unexpectedly greater-than-normal lateral force exerted on the building.

To prevent the building 10 from being tipped over sideways from the foundation, as, for example, by wind, second flange means 55 may be provided extending radially outwardly from the vertical wall 36 of the foundation 32 to overlie in close spaced adjacency the first annular flange means 42. Alternatively, the second, anti-tipping flange means may comprise the flange 56 as shown in FIG. 3 which extends radially inwardly from the vertical flange 52 to underlie the wheels 38. This arrangement is preferable to the arrangement of the flange 55 shown in FIG. 2, since, should the building tip while being rotated, the flange 56 will engage the wheels which will now be rotated in the opposite direction as the flange 42 lifts clear of the wheels so that rotational movement of the building is not impeded as it would be by interengagement of the second flange 55 and first flange 42.

Desirably, the vertical wall means 36 of the foundation is defined by an annular metallic ring 56 surrounding filler material, such as the concrete 58 as shown in FIG. 2, having a flat upper surface 59 defining the floor of the building.

FIG. 3 differs from FIG. 2 in that the filler material is wood and the ring 56 is fixed to the foundation by an L-shaped annular channel 60 having its vertical leg 61 fastened to the ring 56 by the same nuts and bolts 62 utilized to fasten the axles 41 to the ring 56 in both FIGS. 2 and 3. The wood filler may include a polygonal outer frame constructed of edge-mounted lumber 64, such as two-by-fours, to which is fastened, as by screw 66 extending through the horizontal leg 68 of channel 60 the outer edge of flooring 70, which may be thick plywood, defining the floor of the building.

In the building of my prior patent, it was contemplated that the building would in fact shift laterally sideways but that frictional binding effects of this action would be countered by vertical rollers. In the present invention, the only sideways movement of the building is that permitted by the slight tolerance clearance of the wheels 38 on their axles, such being in a maximum range of hundredths of an inch, an amount so slight as to be almost indetectable. Also with the present invention there is minimum impediment to the free rolling movement of the wheels and consequent ease with which the building can be rotated with only slight effort by even a young child.

It will be understood that there may be a series of vertical radially extending walls or dividers mounted on the flat surface 60 of the foundation filler material defining the floor of the building. Any two walls with the annular wall 12, the roof and foundation floor of the building defining a storage compartment which can be readily accessed by merely rotating the wall 12 until the opening 20 therein aligns with the compartment. Thus all manners of disparate articles such as pool equipment or garden tools can be completely segregated within the single building without the necessity of sorting through a large number of non-related articles in order to retrieve a desired article stacked behind unwanted articles.

It will be apparent that the invention is susceptible of a variety of changes and modifications without, however, departing from the scope and spirit of the appended claims.

What is claimed is:

1. A rotatable building having an upstanding vertical wall surmounted by a roof to enclose usable space within said building, said vertical wall having a lower annular skirt portion having a lower edge and inner and outer faces, a fixed foundation extending upwardly from a support surface and having an outwardly facing vertical wall telescopically and co-axially received in radially spaced relationship within said skirt portion, a plurality of circumferentially spaced wheels having inner and outer sides and carried on radially extending horizontal axles mounted on said vertical wall of said foundation in positions spacing the lower peripheries of said wheels vertically clear of said support surface, said axles also radially spacing the inner sides of said wheels from said vertical wall, first flange means extending radially inwardly from the inner face of said skirt portion and having a central portion inwardly radially spaced from said inner face and resting on the upper peripheries of said wheels in a position spacing the lower edge of said skirt portion vertically clear of said support surface, said first flange means having an outer leg portion sloping downwardly and radially outwardly from said central portion into the space between the outer sides of said wheels and the inner face of said skirt portion, an inner leg portion extending downwardly and radially inwardly from said central portion into the space between the inner sides of said wheels and said vertical wall of said foundation, and means rigidly fixing said outer leg portion to the inner face of said skirt portion said central portion of said first flange means closely encompassing the upper peripheral portions of said wheels to space the inner wall of said skirt portion clear of said wheels and axles and to restrict horizontal movement of said skirt portion and hence said building relative to said foundation.

2. The rotatable building of claim 1 including second flange means extending radially outwardly from said vertical wall of said foundation to overlie in close spaced adjacency said first annular flange means so as to prevent said building from tipping sideways from said foundation.

3. The rotatable building of claim 1 wherein the outer peripheral portion of said wheels each have a predetermined cross sectional shape and the central portion of said first flange means has a shape which is complementary to the cross sectional shape of said wheels.

4. The rotatable building of claim 3 wherein said first flange means is of substantially inverted U-shape, and means releasably fastening said outer leg portion of said first flange means rigidly to the inner face of said skirt means.

5. The rotatable building of claim 1 wherein said vertical wall is defined by an annular metallic ring surrounding filler material having a flat upper surface defining the floor of said building.

6. The rotatable building of claim 5 wherein said filler material is concrete.

7. The rotatable building of claim 5 when said filler material is wood.

8. The rotatable building of claim 1 wherein said vertical wall of said building has an opening therethrough, door means for closing said opening, and means for rotating said vertical wall with respect to said foundation for aligning said opening with selected regions of the interior of said building.

9. The rotatable building of claim 1 including second flange means extending radially inwardly relative to the inner face of said skirt means to underlie in close spaced adjacency said wheels so as to prevent said building from the tipping sideways from said foundation.

10. A rotatable building having an upstanding vertical wall surmounted by a roof to enclose usable space within said building, said vertical wall having a lower annular skirt portion having a lower edge and inner and outer faces, a fixed foundation extending upwardly from a support surface and having an outwardly facing vertical wall telescopically and co-axially received in radially spaced relationship within said skirt portion, a plurality of circumferentially spaced wheels having inner and outer sides and carried on radially extending horizontal axles mounted on said vertical wall of said foundation in positions spacing the lower peripheries of said wheels vertically clear of said support surface, said axles also radially spacing the inner sides of said wheels from said vertical wall, means for rotatably supporting said building on said wheels while retaining at all times said inner face of said skirt portion substantially uniformily radially spaced from said wheels and axles comprising an annular flange having a lower face of substantially inverted U-shape and substantially complementary to the cross sectional shape of the peripheries of said wheels, said lower substantially U-shaped face of said flange engaging the upper peripheries of said wheels, and means rigidly securing said flange to said inner face of said skirt with the substantially U-shaped lower face of said flange uniformly spaced radially inwardly between said inner face and said vertical wall and in engagement with said wheels at a vertical position at which the lower edge of said skirt portion is vertically spaced clear of said support surface.

* * * * *